US005249235A

United States Patent [19]

Davis, II et al.

[11] Patent Number: 5,249,235

[45] Date of Patent: Sep. 28, 1993

[54] MICROPHONE WITH CONCEALED PORT

[75] Inventors: James T. Davis, II; Antonio Del Sesto, both of Sunrise; William R. Williams, N. Lauderdale; Mehrdad Badie, Sunrise, all of Fla.

[73] Assignee: Motorola, Inc., Schaumburg, Ill.

[21] Appl. No.: 727,812

[22] Filed: Jul. 8, 1991

[51] Int. Cl.[5] ..... H04R 1/02

[52] U.S. Cl. ..... 381/91; 381/92; 381/122; 381/169

[58] Field of Search ..... 379/406, 410; 455/128; 381/122, 95, 72, 74, 168, 169, 170, 92, 87, 91

[56] References Cited

U.S. PATENT DOCUMENTS

| | | | |
|---|---|---|---|
| 2,896,026 | 7/1959 | Kettler | 381/158 |
| 3,201,530 | 8/1965 | Levy et al. | 381/92 |
| 4,136,265 | 1/1979 | Cote | 381/122 |

*Primary Examiner*—Forester W. Isen

*Attorney, Agent, or Firm*—M. Mansour Ghomeshi

[57] ABSTRACT

Briefly, according to the invention, a microphone apparatus (100) for converting sound waves to electrical signals is described. The microphone apparatus (100) includes a switch (118) for initiating the occurrence of an event. The switch (118) being substantially covered by a cap (102). The microphone apparatus (100) also includes a microphone port (114) disposed substantially behind the cap (102), thus minimizing the obstruction of the microphone port (114).

7 Claims, 3 Drawing Sheets

MICROPHONE WITH CONCEALED PORT

TECHNICAL FIELD

This invention relates generally to microphones and more particularly to method of concealing microphone ports.

BACKGROUND

A directional microphone utilizes front and rear porting to sense the difference between the instantaneous air pressures which impinge on its two surfaces. If an unwanted sound arrives from front of the user, who is talking directly into front of the microphone, it will pass the rear inlet first and with a distance delay reaches the front inlet (facing the user). An internal delay at the rear inlet to the diaphragm is optimally designed to time to cancel the distance delay, thus allowing the unwanted sound to reach the diaphragm from both inlets simultaneously and therefore being cancelled. It is obvious that both front and rear ports must be operating for the microphone to be functioning properly. In many applications such as communication devices, the front port of the directional microphone is protected and can hardly be obstructed since it is placed in the front of the device for direct exposure to the operator's mouth. However, the rear port of the microphone can be easily obstructed. The most common obstructions are caused by the operator's hand covering the rear port as he is using the microphone. Other causes of obstruction may be water (rain) drops that could completely seal the rear port. Such obstructions result in the defeat of the noise cancelling feature of the directional microphone. It is highly desirable for a directional microphone to retain its directional characteristics particularly in communication devices operating in noisy environments and perform its noise cancelling function regardless of the position of the hand of the operator. It is therefore clear that a need exists for a method of situating a microphone port in an electronic device without sacrificing performance of the microphone or the electronic device.

SUMMARY OF THE INVENTION

Briefly, according to the invention, a microphone apparatus for converting sound waves to electrical signals is described. The microphone apparatus includes a switch for initiating the occurrence of an event. The switch is substantially covered by a cap. The microphone apparatus also includes a microphone port disposed substantially behind the cap, thus minimizing the obstruction of the microphone port by foreign objects.

DETAILED DESCRIPTION OF THE PREFERRED EMBODIMENT

Figure 1A:
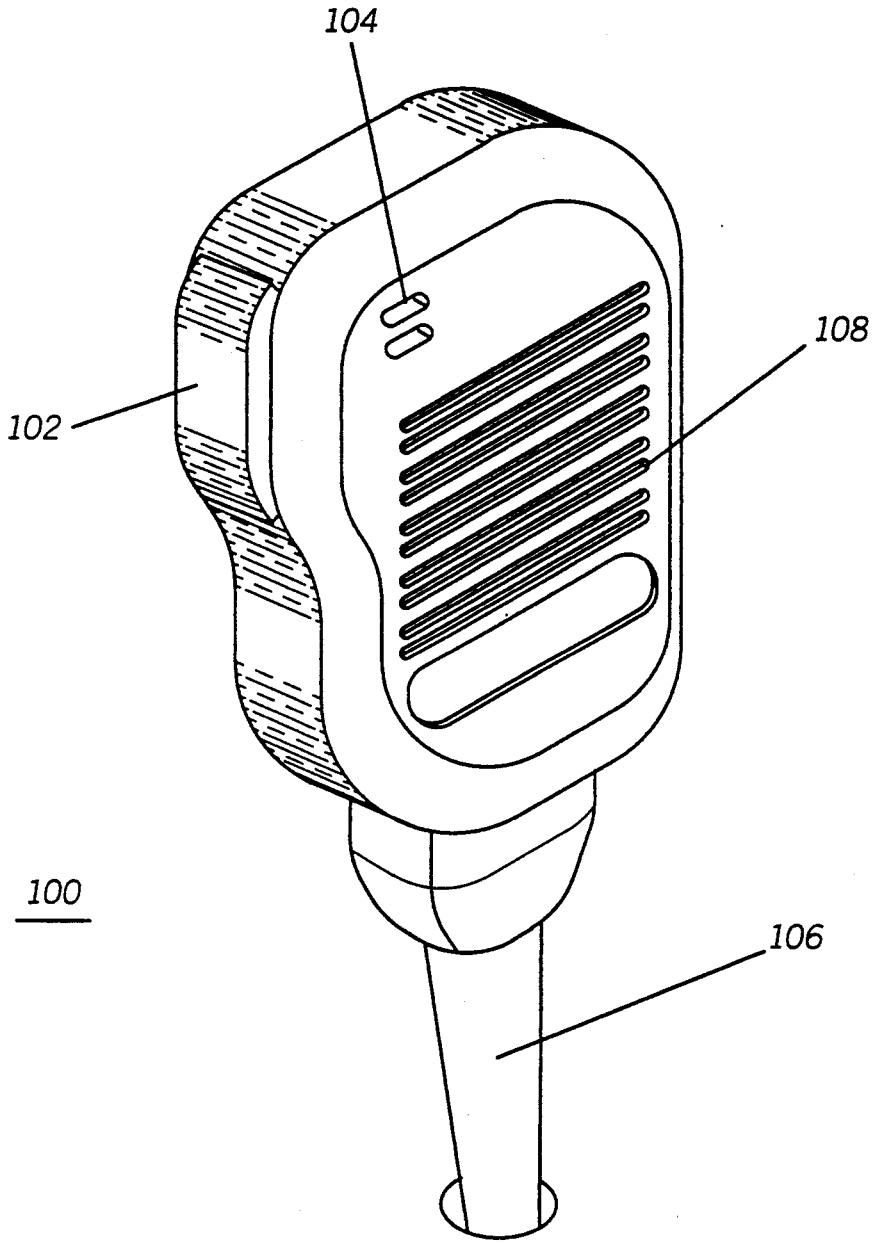
FIG. 1A is a microphone apparatus in accordance with the present invention.

Referring to FIG. 1A, an electronic device preferrably a microphone apparatus 100 is shown in accordance with the present invention. The microphone 100 includes a Push-To-Talk (PTT) cap or button 102, a microphone opening 104, and a cable 106. The microphone opening 104 provides a path for the sound waves to get to the microphone element internal to the apparatus 100. The cable 106 couples the microphone apparatus 100 to a device which processes the signals generated by the microphone 100. A speaker (not shown) may be included in the apparatus 100 to present received audio to a user. A grill 108 protects the internal speaker from the external environment.

Figure 1B:
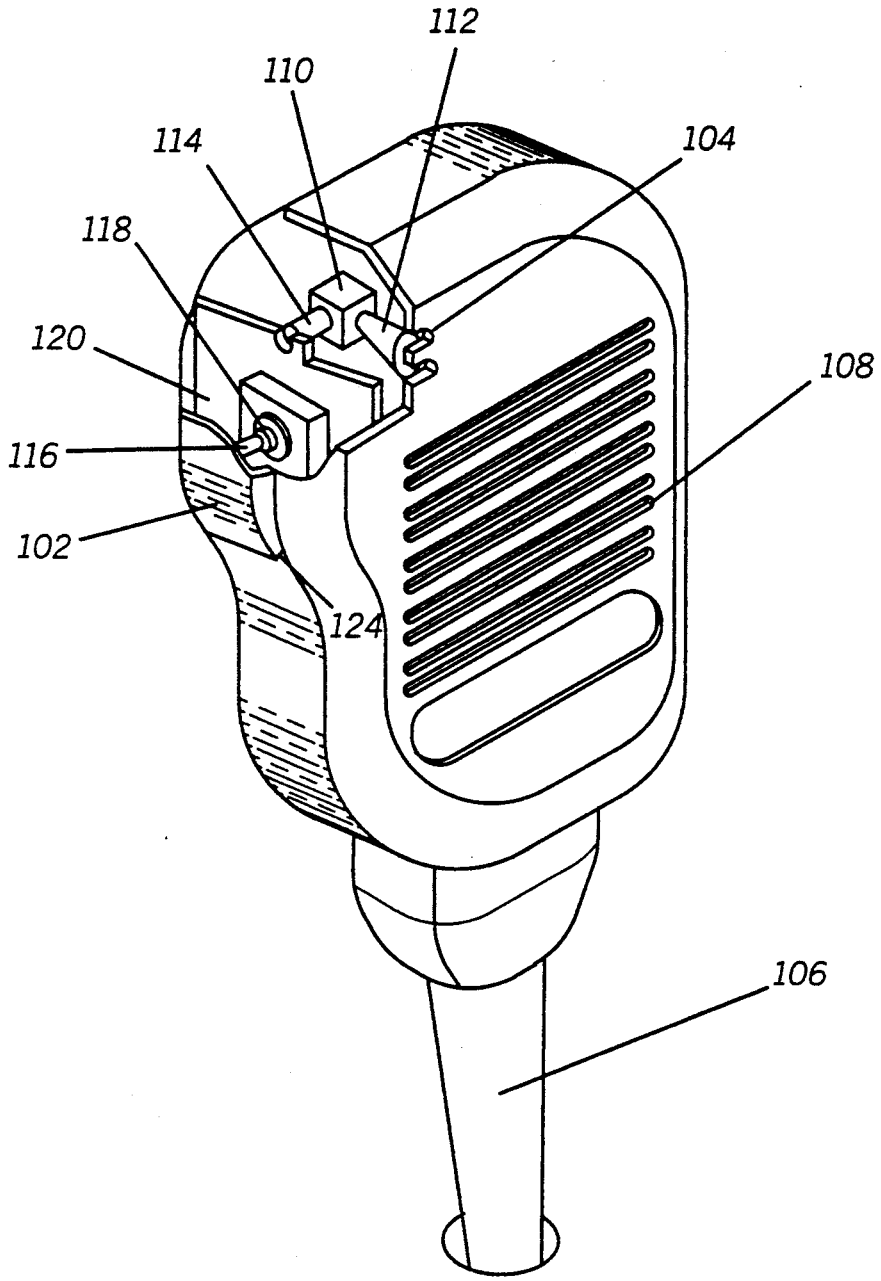
FIG. 1B is the microphone apparatus of FIG. 1A with some of the internal elements shown.

FIG. 1B shows the microphone apparatus 100 with a portion of the internal elements exposed. The exposed area reveals a microphone element 110, preferrably a noise cancelling one, having a first or a front port 112 and second or a rear port 114. The rear port 114 is shown to be substantially disposed behind the cap 102. The microphone element 110 directionally converts sound waves to electrical signals. The operation of directional microphones is well known in the art. In some models, a delay is designed in the microphone ports so that undesired sound waves, such as background noise, reach the microphone diaphragm from both the front and the rear ports simultaneously where they are canceled resulting in minimum electrical signals. On the other hand, desired sound waves are converted to electrical signals for they reach the two ports at different times. The microphone opening 104 provides a path for sound waves to get to the front port 112. The rear port is coupled to a separator 120 which separates the area under the PTT cap 102 and the remainder of the microphone apparatus 100. A switch 118 and an actuator 116 are shown under the cap 102. The cap 102 is a shielding lever used to minimize obstruction of the rear port 114. Note that the cap 102 may be inclusive of the switch 118. The actuator 116 couples the mechanical motion of the cap 102 to the switch 118. Furthermore, the actuator 116 allows the cap 102 to protrude out for improved ergonmics and ease of operation. An air gap 124 is shown around the cap 102 to provide a path for sound waves to reach the rear port 114..This air gap 124 may extend around the entire cap 102 for enhanced air flow. A sufficient pressure applied to the cap 102 is transferred to the switch 118 via the actuator 116. The switch 118 may be a PTT switch in a communication device or any other switch as dictated by the requirements of the apparatus 100 or a device coupled to it.

As explained, the air gap 124 may extend around the cap 102 or portions of it as deemed necessary by the requirements of the apparatus 100. The concealment of the rear port 114 behind the cap 102 minimizes its accidental blockage by the user. If a portion of the gap 124 is accidently covered by the user, other areas remain open for sound waves to reach the rear port 114. The covering of the port 114 via the cap 102 provides for an improved method of protecting an audio port without rendering it ineffective. Additionally, obstruction by foreign objects, such as water are eliminated for there is no longer one specific point of entry for sound waves. Another benefit of this invention is that only the front port 122 is exposed to the user. This eliminates confusion as to which port the user should talk into.

Figure 2:
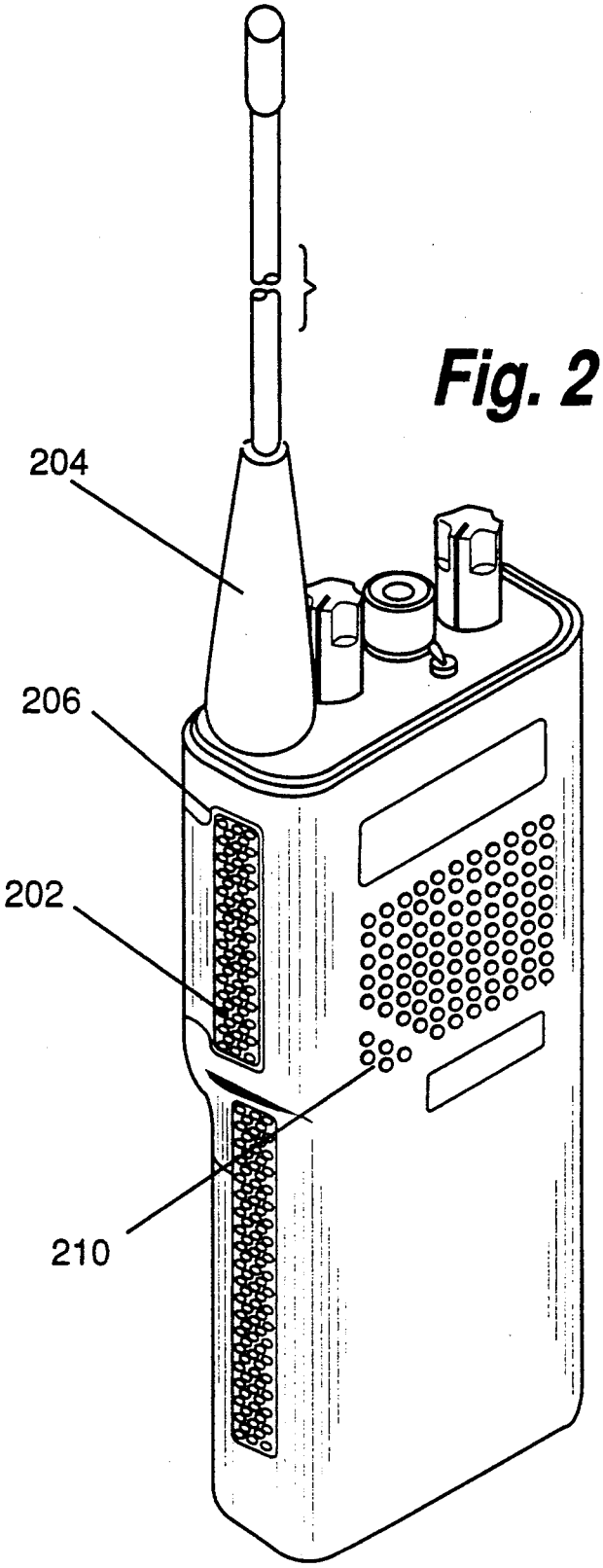
FIG. 2 is a communication device in accordance with the present invention.

Referring now to FIG. 2, a communication device 200 such as a two-way radio is shown in accordance with the present invention. The communication device 200 includes an antenna 204 which is used to transmit and receive communication signals. A Push-To-Talk (PTT) switch 202 is provided to activate transmission. The user presses the PTT switch 202 indicating to the communication device 200 his or her desires to initiate a transmission. A microphone port 210 is included in the communication device 200. This port 210 is the front port of a microphone element (not shown) in the device 200. Covered by the PTT switch 202, is the rear port (not shown) of this microphone element. An air gap 206 is provided around the PTT switch 202 to allow sound waves to reach the rear port. Similar to the microphone 100, the air gap 206 may assume any shape as dictated by the requirements. Once again, it can be seen that the chances of accidental covering of the rear port are significantly reduced by locating the rear port substantially behind the PTT switch 202.

To summarize, a directional microphone apparatus having a PTT switch is described. The microphone includes a front port and a rear port. The rear port is concealed via a cap that is used to cover the PTT switch. An air gap around the cap provides a path for sound waves to reach the rear port. Accidental or inadvertent obstruction of the rear port is minimized due to the extended shape of the air gap. The confusion as to which port the user should communicate through is eliminated for there is only one exposed port.

What is claimed is:

1. A microphone apparatus for converting sound waves to electrical signals, comprising:

a switch for initiating an event, the switch being substantially covered by a cap;

a directional microphone, including;

a first microphone port for receiving sound waves; and a second microphone port for receiving sound waves, and disposed substantially behind the cap.

2. The communication device of claim 1, wherein the microphone port comprises a second port of a directional microphone.

3. The communication device of claim 1, wherein the cap includes a plastic membrane.

4. A communication device, comprising:

a transmitter for transmitting a signal, the transmitter including:

an actuation switch;

a noise cancelling microphone having a first and a second port; and a shielding cover for covering the actuation switch and the second port of the microphone to minimize obstruction to the second port of the microphone.

5. The communication device of claim 4, wherein the actuation switch includes a PTT switch.

6. The communication device of claim 4, wherein the noise cancelling microphone includes a directional microphone.

7. The communication device of claim 4, wherein the shielding cover comprises a cap.

* * * * *